US006974389B1

(12) United States Patent
Shioda

(10) Patent No.: US 6,974,389 B1
(45) Date of Patent: Dec. 13, 2005

(54) GOLF PRACTICE AND EXERCISE DEVICE

(76) Inventor: Yoshihiko Shioda, 3416 Royal Crest Dr., Charlotte, NC (US) 28210-3037

( * ) Notice: Subject to any disclaimer, the term of this patent is extended or adjusted under 35 U.S.C. 154(b) by 0 days.

(21) Appl. No.: 09/444,120

(22) Filed: Nov. 19, 1999

(51) Int. Cl.[7] ..... A63B 57/00
(52) U.S. Cl. ..... 473/147
(58) Field of Search ..... 473/139, 147, 473/423, 429, 430, 427, 422, 219, 226, 256, 473/280; 482/86, 87, 88, 89, 90

(56) References Cited

U.S. PATENT DOCUMENTS

| | | | | |
|---|---|---|---|---|
| 708,573 | A * | 9/1902 | Miles | |
| 1,700,224 | A * | 1/1929 | Henderson | |
| 1,847,570 | A * | 3/1932 | McLaughlin | |
| 3,126,206 | A | 3/1964 | Sabia | |
| 3,168,312 | A * | 2/1965 | Davis | 473/423 |
| 3,194,557 | A | 7/1965 | Holley | |
| 3,397,885 | A | 8/1968 | Nash, Jr. | |
| 3,425,700 | A | 2/1969 | Edwards | |
| 3,427,030 | A | 2/1969 | Ward | 273/176 |
| 3,729,195 | A | 4/1973 | Hutt et al. | 273/58 C |
| 3,764,140 | A | 10/1973 | Lofty | 273/95 A |
| 3,862,757 | A * | 1/1975 | Craig | 273/58 C |
| 4,026,561 | A | 5/1977 | Baldorossi et al. | 273/193 R |
| 4,093,234 | A | 6/1978 | Barton | |
| 4,123,053 | A * | 10/1978 | Piccini | 273/26 R |
| 4,150,826 | A | 4/1979 | Baldorossi et al. | 273/218 |
| 4,240,629 | A | 12/1980 | Song et al. | 273/58 C |
| 4,326,717 | A | 4/1982 | McClimon | |
| 4,359,225 | A | 11/1982 | Baldorossi et al. | 273/178 A |
| 4,507,211 | A | 3/1985 | Naylor et al. | |

(Continued)

FOREIGN PATENT DOCUMENTS

| | | |
|---|---|---|
| CA | 2108955 | 4/1995 |

(Continued)

OTHER PUBLICATIONS

Impact Bag trade literature brochure of Golf Around the World, Inc., 1396 North Killian Drive, Luke Park, Florida 33403.

(Continued)

*Primary Examiner*—Raeann Gorden
(74) *Attorney, Agent, or Firm*—Kennedy Covington Lobdell & Hickman, LLP

(57) ABSTRACT

A golf practice and exercise device having a frame with a horizontally projecting arm spaced from a base or from the ground and from which is suspended by a cord an object that may take various forms, such as similar to a standard softball, a teardrop-shaped punching bag, a body punching bag, or any other suitable form. The object is positioned with a clubhead impact surface in position for striking by the clubhead of a golf club being swung by a golfer. The impact surface is sufficiently large that a golfer need not concentrate on striking a small target as is required when swinging at a golf ball. The mass of the object is sufficient to provide substantial resistance to the impact of a golf club to impose muscle strain on the golfer for muscle development, but is limited in mass to allow the head of the golf club to swing the object sufficiently for the golf clubhead to ultimately pass under the object and allow the golfer to complete the follow-through of the golf swing. In an alternate form, the object to be struck rests on the ground and is attached to a flexible cord which, in turn, is attached to a spike, secured in the ground. The cord and spike provide a limit to the distance the object will move so that the device can be used in a restricted space.

6 Claims, 4 Drawing Sheets

U.S. PATENT DOCUMENTS

| | | | | | |
|---|---|---|---|---|---|
| 4,508,340 | A | | 4/1985 | Liao | |
| 4,527,796 | A | * | 7/1985 | Critelli | 272/77 |
| 4,555,110 | A | * | 11/1985 | Hai-Ping | 473/429 |
| 4,660,834 | A | | 4/1987 | Carrigan | |
| 4,772,019 | A | * | 9/1988 | Morgan | 273/608 |
| 4,940,238 | A | | 7/1990 | Bradley | |
| 4,989,876 | A | | 2/1991 | Hawkins, Sr. et al. | |
| 5,026,054 | A | | 6/1991 | Osher et al. | |
| 5,255,920 | A | | 10/1993 | Mangeri | |
| 5,282,615 | A | | 2/1994 | Green et al. | 273/26 E |
| 5,330,403 | A | * | 7/1994 | Kuo | 482/83 |
| 5,366,225 | A | | 11/1994 | Lazar | |
| 5,380,002 | A | | 1/1995 | Spector | |
| D366,679 | S | * | 1/1996 | Clements | D21/199 |
| 5,513,842 | A | | 5/1996 | Fuss | |
| 5,542,661 | A | | 8/1996 | Gregan | 273/26 |
| 5,560,604 | A | | 10/1996 | Watt | |
| 5,577,964 | A | | 11/1996 | Chen | |
| 5,605,326 | A | * | 2/1997 | Spear | 273/26 R |
| 5,842,938 | A | | 12/1998 | Garber | 473/430 |
| 5,865,683 | A | | 2/1999 | Yang | 473/147 |
| 5,876,291 | A | | 3/1999 | Dubose | |
| 6,030,303 | A | * | 2/2000 | Wallace | 473/575 |
| 6,053,829 | A | | 4/2000 | Conley | |
| 6,190,272 | B1 | | 2/2001 | Bernard | |
| 6,217,458 | B1 | | 4/2001 | Armstrong, III et al. | |
| 6,319,145 | B1 | | 11/2001 | Coughlan | |
| 2002/0082101 | A1 | | 6/2002 | Shioda | 473/197 |
| 2002/0111222 | A1 | | 8/2002 | Shioda | 473/197 |

FOREIGN PATENT DOCUMENTS

| | | |
|---|---|---|
| EP | 1 219 327 A2 | 7/2002 |

OTHER PUBLICATIONS

P. 20, Golf Around the World catalog.
European Search Report.

* cited by examiner

FIG. 5.
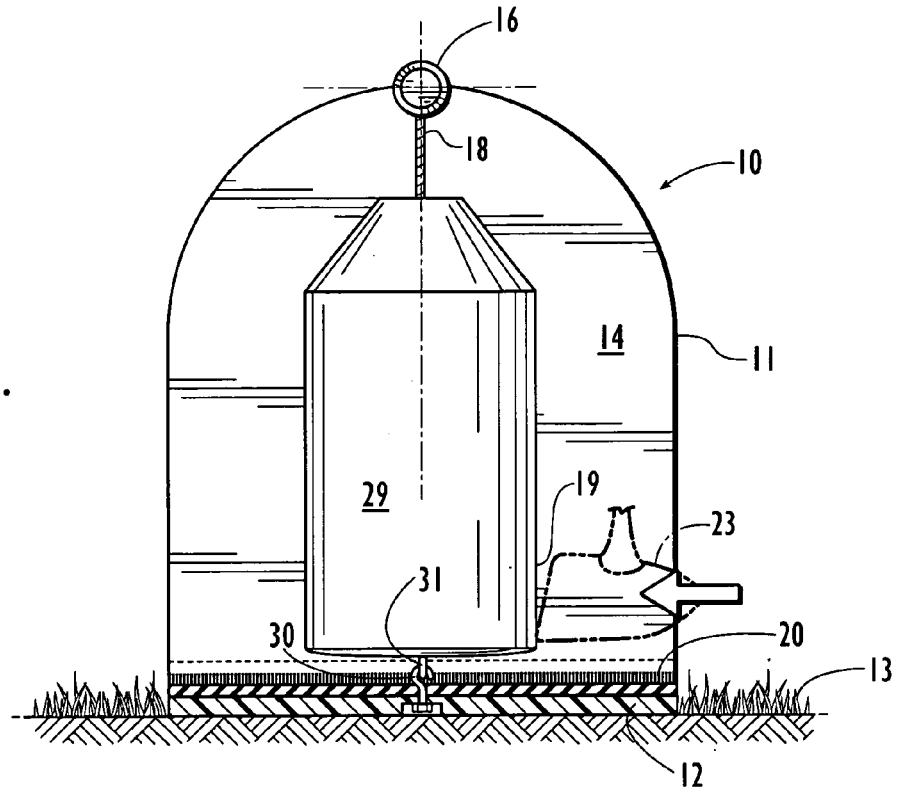
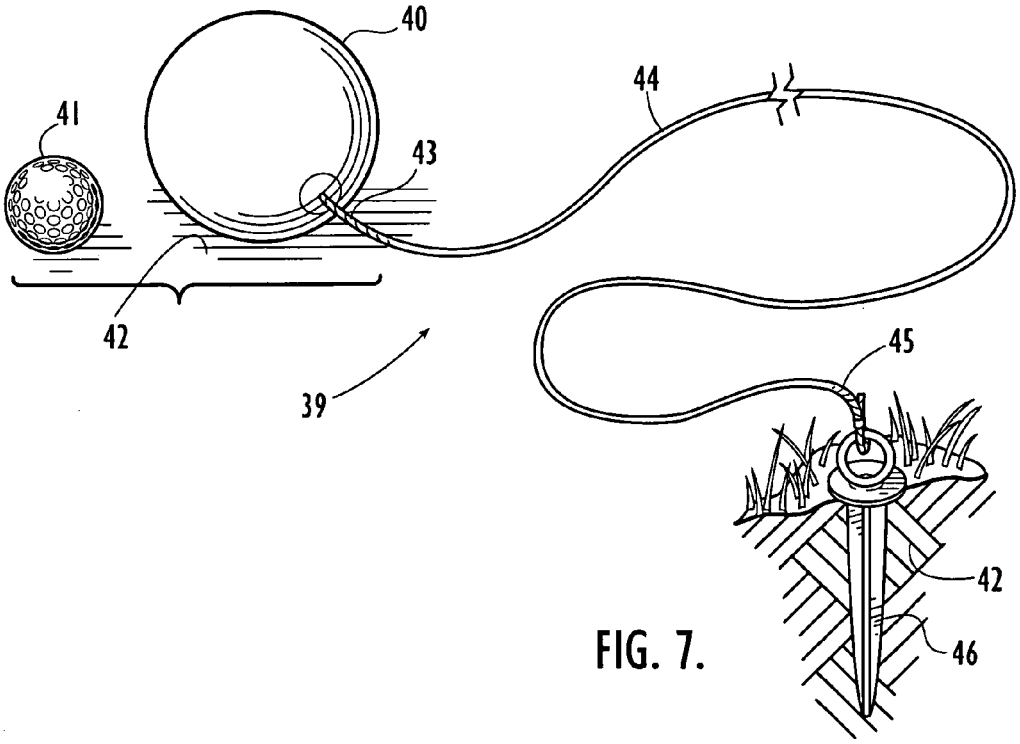
FIG. 7.

GOLF PRACTICE AND EXERCISE DEVICE

FIELD OF THE INVENTION

The present invention relates to golf practice and exercise devices that improve the user's golf swing and develops the muscles used in a golf swing.

BACKGROUND OF THE INVENTION

There are many prior devices that have been developed for golfers to practice to improve their swing. One type suspends a golf ball-sized object from the end of a cord in a position for being struck by the head of a golf club being practice swung by a golfer. Such devices allow a golfer to practice his swing and improve the technique and path of a swing in a confined space instead of having to use a driving range. However, the object being struck is a golf ball or the size of a golf ball and, therefore, provides little muscle-building resistance.

Another type of practice device is a relatively large bag known as an Impact Bag that is intended to be filled with soft material, such as towels, and is placed against a stationary object that prevents displacement of the bag. Such a device is intended to be used to stop a practice swing at the point of impact so that the golfer can evaluate the club's and his body's positions at impact. It does not allow the golfer to complete the follow-through of a golf swing and to perform a muscle building exercise by overcoming the resistance of a weight as the club moves through impact into the follow-through.

In contrast, the present invention provides a combination of practicing techniques as well as building the muscles used in swinging a golf club.

SUMMARY OF THE INVENTION

Briefly described, the golf practice and exercise device of the present invention includes a frame member having a base portion for supporting the device on a floor or on the ground. The frame member extends upwardly from the base member and has an outwardly extending mounting arm from which an object is swingably suspended in position for striking by a golf clubhead during a normal practice golf swing. The object has a golf clubhead impact surface approaching the size of or greater than the corresponding surface of a standard softball to provide a large target so that the golfer can swing freely without concentration on striking a small target, such as a golf ball. The object also has a mass approaching that of or exceeding that of a standard softball to provide substantial resistance to the impact of a golf club to impose muscular strain on the golfer for muscle development, but the object is limited in mass to allow the head of the golf club to swing the object sufficiently for the golf clubhead to ultimately pass under the object and allow the golfer to complete the follow-through of the golf swing. Thus, the device of the present invention provides for practicing the technique of the golf swing, as well as providing muscle development to enhance the striking force exerted by the golfer when striking a golf ball. In one form, the object may be substantially the same as a standard softball and be approximately 4 to 5 inches in diameter and weigh approximately 4 to 12 ounces, preferably 6 to 7 ounces.

In another form, the object may be substantially the same as a teardrop-shaped punching bag having dimensions and weight similar to those recited above.

In a further form, the object may be substantially the same as a cylindrical body punching bag. The diameter of the object may be approximately 3 to 12 inches, preferably 6 to 10 inches, and the weight may be approximately 1 to 12 pounds, preferably 6 pounds. The height of the object may be approximately 10 to 18 inches.

In the preferred embodiment, the arm from which the object is suspended to the striking position may be 1½ feet to 5 feet above the ground or floor, preferably 3 feet. The object is suspended from the arm by a cord attached to the object and attached to a ring that is freely rotatably mounted on the arm for rotation of the ring, cord and object about a generally horizontal axis.

As a variation of the present invention, the object may be alternatively attachable to the base, as well as to the mounting arm, for restraining the object against movement for alternative use of the object as a stop of the golf club in an impact position.

In a further embodiment, a spherical object of the type described above may be used without mounting in a frame, but simply placing on the ground or floor for striking, with the object secured at the end of a cord that is secured to the ground or floor to limit the distance the object can move after it has been struck. The size and weight of the object similarly provides practice of a golf swing technique as well as providing muscle enhancing resistance, with the cord limiting the distance the object can move after it has been struck so that the device can be used in a restricted space.

It should be understood that the present invention could be adapted to other shapes and sizes that provide a large enough striking surface that the practicing golfer need not concentrate on the precise location of striking, which a golfer must do with a small object, such as a golf ball, and weighs in a range that is sufficient to result in a mass that provides muscle building resistance yet can be displaced by a practice swing so that the golfer is able to complete the follow-through of the swing for the feel and practice of a complete swing.

In any of the embodiments the object may include a cover, such as a pouch or similar covering, made of a relatively soft material, such as a textile fabric of any desired thickness to provide a softening of the impact of the clubhead against the object.

BRIEF DESCRIPTION OF THE DRAWINGS

FIG. 3 is a view similar to FIG. 2, illustrating the object of the device of the invention being displaced as a golf clubhead advances past the initial impact position and showing the position of a golf clubhead after it has passed under the object during follow-through;

FIG. 5 is a view similar to FIG. 2, illustrating the device of the present invention with an object that is capable of alternative use as a swinging object and as a stationary object;

FIG. 7 is a perspective view showing an object according to the golf practice and exercise device of the present invention that is attached to a cord that is anchored in the ground.

DESCRIPTION OF THE PREFERRED EMBODIMENTS

Figure 1:
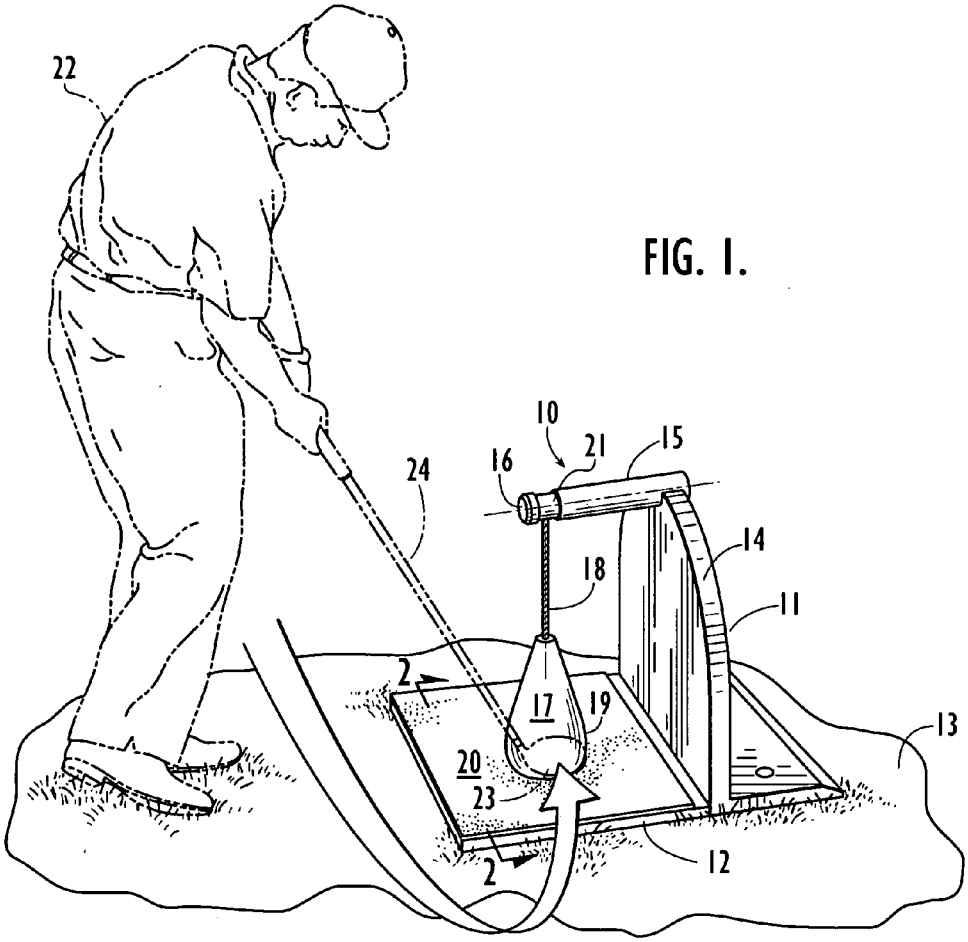
FIG. 1 is a perspective view of a golf practice and exercise device according to one of the preferred embodiments of the present invention, illustrating a golfer with a golf club in the striking position.
Figure 2:
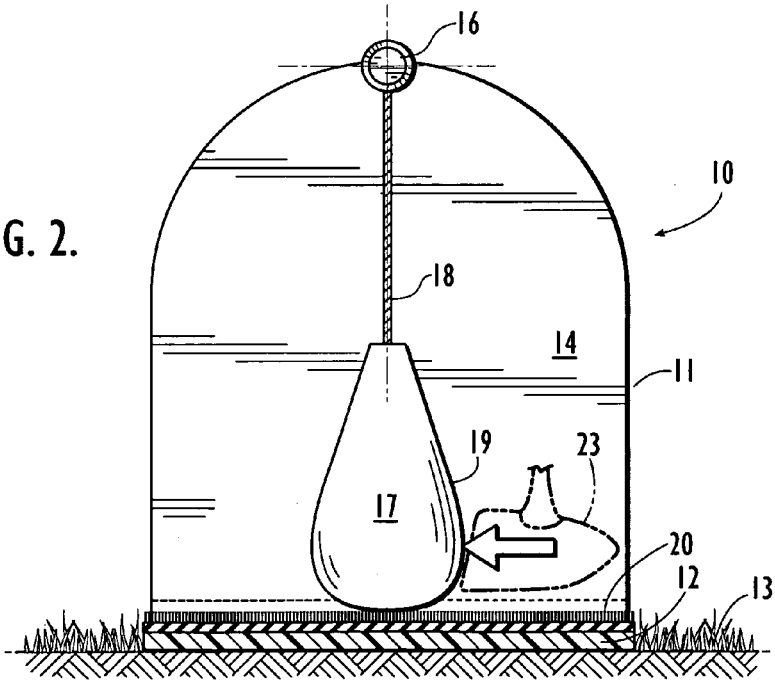
FIG. 2 is a front elevation view of the device of FIG. 1 illustrating the impact position of a golf clubhead in dotted lines.
Figure 3:
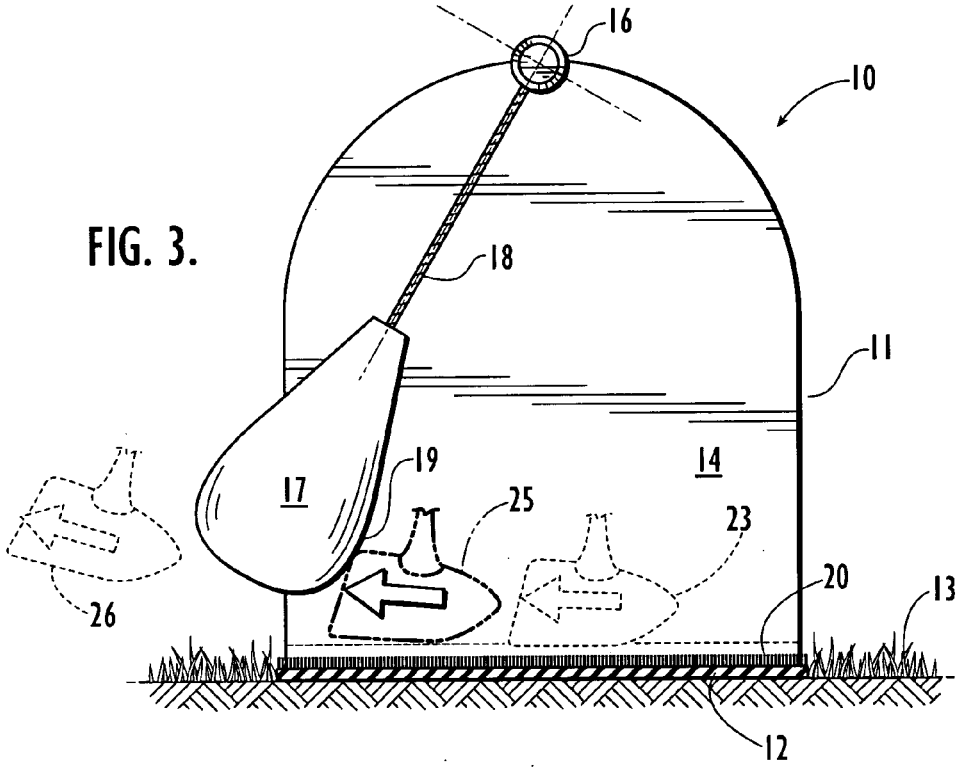

One of the preferred embodiments of the golf practice and exercise device of the present invention is illustrated in FIGS. 1, 2 and 3. This device 10 includes a frame 11 having a flat base portion 12 formed for seating on the ground 13 or the floor. Extending upwardly from the base portion 12 is an upright portion 14. At the upper extent of the upright portion 14 a mounting arm 15 projects outwardly over a portion of the base portion 12. At the outer end 16 of the mounting arm 15, an object 17 to be struck by a golfer 22 is suspended by a flexible cord 18 so that the object 17 has a golf clubhead impact surface 19 in position relative to the base portion 12 for striking by a golf clubhead swung by a golfer 22. The size of the golf clubhead impact surface approaches the size of or is greater than the corresponding surface of a baseball to provide a large target so that the golfer can swing freely without concentration on striking a small target as is the case when swinging at a golf ball. To simulate the ground and to prevent damage to a club 24 being swung, a conventional mat 20 is secured to the top of the base portion 12 under the object 17.

The flexible cord 18 is attached to a ring 21 that is freely rotatably mounted at the outer end 16 of the arm 15 for rotation of the ring, cord and object about a generally horizontal access. With this arrangement, the object 17 will swing like a pendulum when it is struck. If the object is of small enough mass and the clubhead 23 strikes with sufficient force, the object 17 may be caused to swing totally around the arm 15. On the other hand, the weight of the object 17 and the force of the swing may only be sufficient to cause a pendulum-like oscillation of the object 17.

In the embodiment illustrated in FIGS. 1, 2 and 3, the object 17 may be substantially the same as a teardrop-shaped punching bag used by boxers when training, having a similar mass that imposes muscular strain on the golfer when struck for muscle development but being limited in mass to allow the head of the golf club to swing the object sufficiently for the golf clubhead to ultimately pass under the object and allow the golfer to complete the follow-through of the golf swing. Typically, the object 17 will be 4 to 5 inches in diameter and weigh approximately 4 to 12 ounces, preferably 6 to 7 ounces. The mass may be provided by a core of tightly wound yarn or string or a sawdust or similar composted filler or yarn or string wound around a core or a sand filler. Various other materials can be used that provide the desired results.

When a golfer 22 uses the device 10 of FIGS. 1, 2 and 3, he positions himself in an address position with the clubhead 23 of his club 24 at or contacting the striking surface 19 of the object 17. The golfer 22 then takes a normal back swing and then a down swing with the clubhead 23 striking the impact surface 19 of the object 17. Because of the size of the impact surface 19 of the object 17, the golfer 22 need not be concerned or concentrate on the specific location of the clubhead 23 at the striking surface 19 as he is when practicing with a golf ball. Also, due to the mass of the object 17, the golfer will swing hard at the object 17, considerably harder than the golfer would normally think about when striking a small light golf ball. This action in swinging at the object 17 somewhat resembles the effort and position of striking an object with a sledgehammer, knowing the resistance that will meet the impact. This facilitates the golfer utilizing his body to provide maximum force, which, as illustrated in FIG. 1, results in him obtaining a proper body turn and positioning at the point of impact. This not only trains the golfer to arrive at a proper ball striking position, but places the golfer in position for continuing through the swing against the resistance of the object 17, thereby providing for practicing of technique as well as building strong muscles that are used in the golf swing.

Because of the mass of the object 17, the golfer knows that he must continue exerting force against the object 17 sufficient to swing it past the impact position so that the clubhead 23 can ultimately move under the object 17 and through completion of the follow-through of the swing. This movement of the object 17 by the clubhead 23 is illustrated at 25 in FIG. 3 and the position of the clubhead after displacing the object 17 and moving under and away therefrom is illustrated at 26 in FIG. 3.

In the preferred embodiment, the mounting arm 15 is approximately 1½ to 5 feet above the ground, preferably 3 feet above the ground, for an optimum swing path of the object 17 in relation to the swing path of the clubhead 23.

Figure 4:
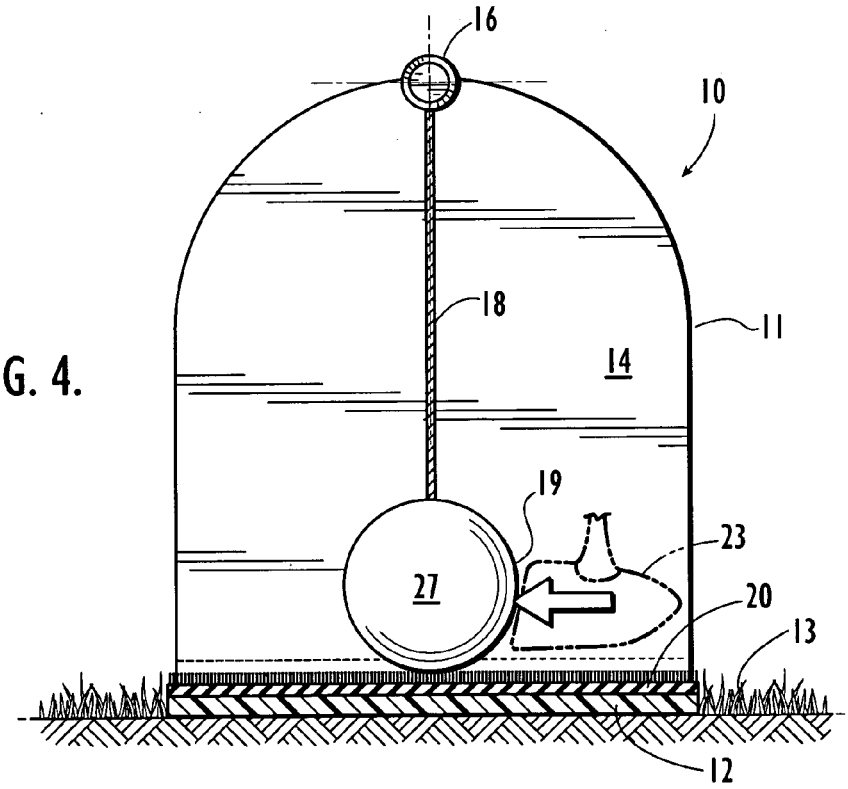
FIG. 4 is a view similar to FIG. 2 illustrating the device of the present invention with an alternate form of the object.

In the embodiment illustrated in FIG. 4, the object 27 is a spherical object that is substantially the same size and weight as a conventional softball. It may be approximately 4 to 5 inches in diameter and weigh approximately 4 to 12 ounces, preferably 6 to 7 ounces. Otherwise, this embodiment is identical to the embodiment of FIGS. 1, 2 and 3.

FIG. 5 illustrates an object 29 in a form substantially the same as a cylindrical body punching bag used by boxers in training. It may be approximately 3 to 12 inches in diameter, preferably 6 to 10 inches in diameter, and may weigh approximately 1 to 12 pounds, preferably approximately 6 pounds. It may be approximately 10 to 18 inches in height.

This embodiment of FIG. 5, includes fastening means in the form of a hook 30 secured and extending upwardly from the base portion 12 and an eyelet 31 secured to and extending downwardly from the object 29 for connection with the hook 30. This fastening means allows the object 17 to be selectively used to restrain the object 29 against movement for alternative use of the object 29 as a stop of the golf club in an impact position, should the golfer desire to use the device in this manner. Preferably, the hook 30 and eyelet 31 would be attached to the base portion 12 and the object 29, respectively, in at least a partially retracted position when not engaged so as not to interfere with or damage the clubhead when the object 29 is used as a moving object as described above. If desired, the object 29 of the embodiment of FIG. 5 can be permanently secured in the stationary position described, or two objects can be used selectively, one for swing and one for stationary use.

In the embodiments of FIGS. 1–5, the object 17, 27, 29 may be suspended from the outer end 16 of the mounting arm 15 by a thin rigid rod, rather than a flexible cord 18, with the rod being pivoted similarly by attachment to the ring 21 for rotation of the rod and object about the mounting arm 15 when struck by a golf club.

Figure 6:
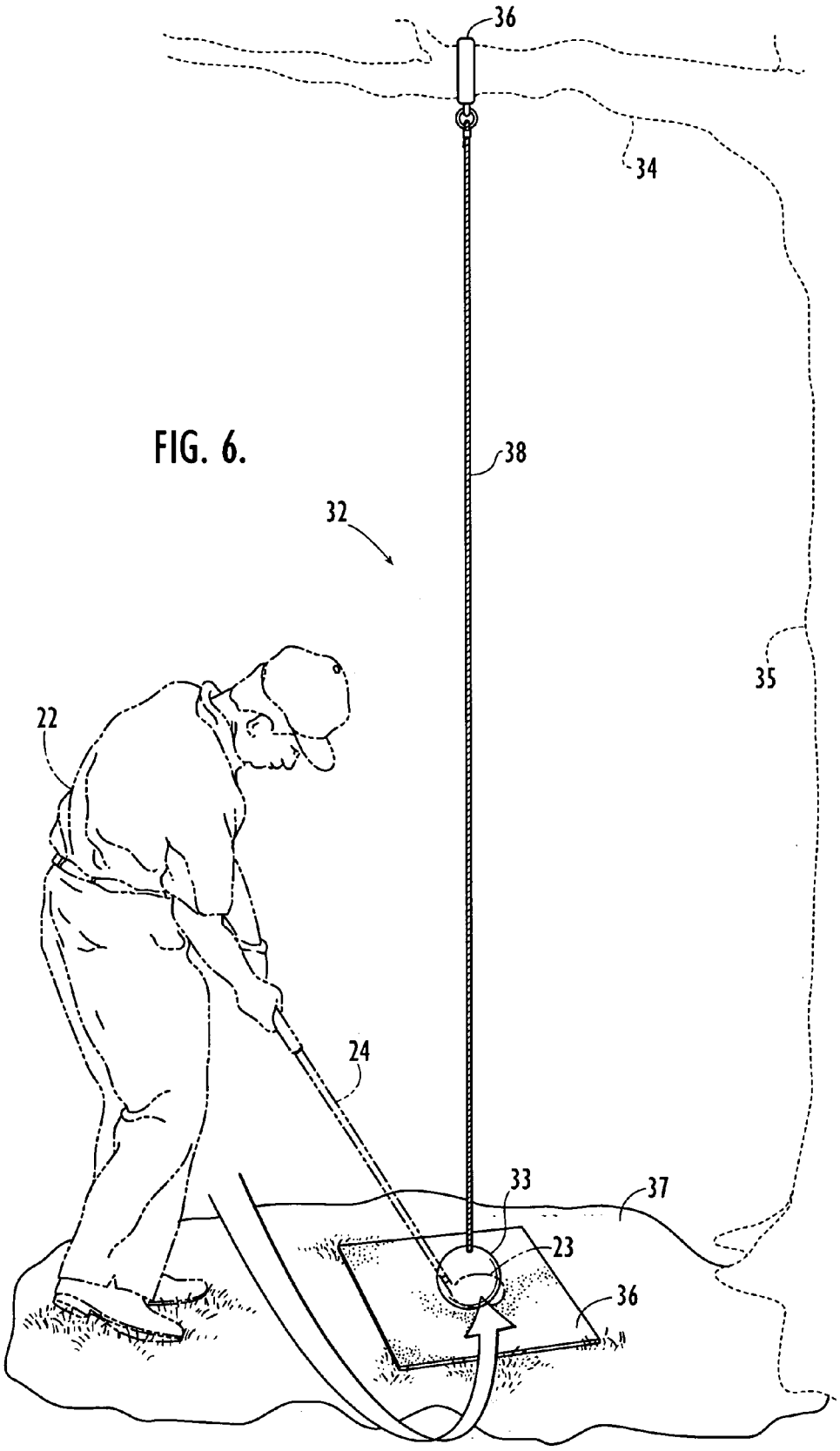
FIG. 6 is a view similar to FIG. 4, illustrating the device of the present invention adapted for suspending the object from the limb of a tree rather than from the arm of a frame.

The golf practice and exercise device 32 of FIG. 6 is similar to the softball type of device illustrated in FIG. 4, but differs in that the object 33 is suspended from the limb 34 of a tree 35 using a mounting ring 36 attached to the tree limb 34. A mat 36 is disposed on the ground 37 under the object 33, and a cord 38 is attached to the ring 36 and to the object 33, with the length of the cord 38 being adjusted to properly position the object 33 closely adjacent to the mat 36. In this embodiment, the ground and tree serve as the frame, with the trunk of the tree extending as an upright portion and the limb 34 serving as the mounting arm.

Another alternative to the frame described in the embodiments of FIGS. 1–6 is the use of a rod or rods extending rigidly downwardly from the upright portion for insertion in the ground to hold the frame in the upright position. The ground would then serve as the base portion and a mat would be placed on the ground with the object to be struck being suspended from an arm portion projecting from the upright portion as in the embodiments illustrated and described above.

While specific shapes of the object of the golf practice and exercise device of the present invention are illustrated and described with reference to FIGS. 1–7, it should be understood that other shapes are within the scope of the present invention. Basically, regardless of the shape, the object should have a golf clubhead impact surface approaching the size of or greater than the corresponding surface of a baseball to provide a large target so that the golfer can swing freely without concentration on striking a small target, and the object should have a mass approaching that of or exceeding that of a baseball to provide substantial resistance to the impact of a golf club to impose muscular strain on the golfer for muscle development, but being limited in mass to allow the head of the golf club to swing the object sufficiently for the golf clubhead to ultimately pass under the object and allow the golfer to complete the follow-through of the golf swing. In the spherical form of the object, it is approximately 3 to 8 inches in diameter, preferably 3 inches in diameter, and weighs 3 to 12 ounces, preferably 5 ounces. In all embodiments, a filler may be inserted in the object to obtain the desired mass as described above with regard to the embodiment of FIGS. 1, 2, 3 and 4.

In any of the embodiments the object may include a cover, such as a pouch or similar covering, made of a relatively soft material, such as a textile fabric of any desired thickness to provide a softening of the impact of the clubhead against the object.

Another form of the device of the present invention is illustrated in FIG. 7. This device 39 includes an object 40 illustrated as being of about the same size as the softball-type object 27 illustrated in FIG. 4. It could be of any other size spherical object having the size and weight described above in regard to the other embodiments. The relative size of a golf ball 41 is illustrated next to the object 40 in FIG. 7.

The object 40 of the device 39 of FIG. 7 rests on the ground 42 for striking by a golf clubhead during the golf swing of a golfer using this device 38 for practice and exercise. The object 40 is attached to one end 43 of a flexible cord 44 of substantial length. The cord 44 has its other end 45 attached to a spike 46 that is inserted in the ground. When a golfer takes a practice swing and strikes the object 40, the object is moved sufficiently to allow the golfer to complete the follow-through of the golf swing, and the flexible cord 44 limits the distance the object can move after it has been struck so that the device can be used in a confined space.

It should be noted that the mass of the object of any of the embodiments may be large enough to allow a golfer to swing easy and have the object stop the clubhead in the impact position while the mass allows a golfer to take a full swing that causes movement of the object for completion of the follow-through of the golf swing. Alternatively, the device can be provided with objects of two different masses, one large enough to serve as an impact bag to stop the clubhead at the point of impact and the other being light enough within the parameters described above, to allow movement of the object for completion of the follow-through of the golf swing.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A golf practice and exercise device for use with a golf club, comprising a frame member having a base portion for supporting the device on a floor or ground, said frame member extending upwardly from the base member and having an outwardly extending mounting arm, and an object swingably suspended from said mounting arm with at least a portion of said object adjacent the floor or ground in position to be struck by a golf clubhead during a normal swing of a golf club, said object having a golf clubhead impact surface of a size at least that of the corresponding surface of a softball to provide a large target so that the golfer can swing a golf club freely without concentration on striking the small target of a golf ball, said object being of a mass at least that of a softball to provide substantial resistance to the impact of a golf club to impose muscular strain on the golfer for muscle development but being limited in mass to allow the head of a golf club to swing the object sufficiently for the golf clubhead to ultimately pass under the object and allow the golfer to complete the follow-through of the golf swing, wherein said object is substantially the same as a teardrop-shaped punching bag.

2. A golf practice and exercise device according to claim 1 in which said object is approximately 4 to 5 inches in diameter.

3. A golf practice and exercise device according to claim 2 in which said object weighs approximately 4 to 12 ounces.

4. A golf practice and exercise device according to claim 2 in which said object weighs approximately 6 to 7 ounces.

5. A golf practice and exercise device for use with a golf club, comprising a frame member having a base portion for supporting the device on a floor or ground, said frame member extending upwardly from the base member and having an outwardly extending mounting arm, and an object swingably suspended from said mounting arm by a flexible cord, said cord being attached to a ring that is freely rotatably mounted on said arm for rotation of said ring, cord and object about a generally horizontal axis, with at least a portion of said object adjacent the floor or ground in position to be struck by a golf clubhead during a normal swing of a golf club, said object having a golf clubhead impact surface of a size at least that of the corresponding surface of a softball to provide a large target so that the golfer can swing a golf club freely without concentration on striking the small target of a golf ball, said object being of a mass at least that of a softball to provide substantial resistance to the impact of a golf club to impose muscular strain on the golfer for muscle development but being limited in mass to allow the head of a golf club to swing the object sufficiently for the golf clubhead to ultimately pass under the object and allow the golfer to complete the follow-through of the golf swing.

6. A golf practice and exercise device for use with a golf club, comprising a frame member having a base portion for supporting the device on a floor or ground, said frame member extending upwardly from the base member and having an outwardly extending mounting arm, and an object swingably suspended from said mounting arm with at least a portion of said object adjacent the floor or ground in position to be struck by a golf clubhead during a normal swing of a golf club, said object having a golf clubhead impact surface of a size at least that of the corresponding surface of a softball to provide a large target so that the golfer can swing a golf club freely without concentration on striking the small target of a golf ball, said object being of a mass at least that of a softball to provide substantial resistance to the impact of a golf club to impose muscular strain on the golfer for muscle development but being limited in mass to allow the head of a golf club to swing the object sufficiently for the golf clubhead to ultimately pass under the object and allow the golfer to complete the follow-through of the golf swing, said object being alternatively attachable to said base for restraining said object against movement for alternative use of said object as a stop of the golf club in an impact position.

* * * * *